US011738960B2

(12) United States Patent
Barberan Latorre

(10) Patent No.: US 11,738,960 B2
(45) Date of Patent: Aug. 29, 2023

(54) SUBSTRATE PRINTING SYSTEM

(71) Applicant: Jesus Francisco Barberan Latorre, Castelldefels (ES)

(72) Inventor: Jesus Francisco Barberan Latorre, Castelldefels (ES)

( * ) Notice: Subject to any disclaimer, the term of this patent is extended or adjusted under 35 U.S.C. 154(b) by 317 days.

(21) Appl. No.: 16/951,649

(22) Filed: Nov. 18, 2020

(65) Prior Publication Data

US 2021/0155431 A1 May 27, 2021

(30) Foreign Application Priority Data

Nov. 21, 2019 (EP) ..... 19383027

(51) Int. Cl.

| | |
|---|---|
| ***B65H 5/22*** | (2006.01) |
| ***B41J 11/00*** | (2006.01) |
| ***B65H 11/00*** | (2006.01) |
| *B65H 29/32* | (2006.01) |

(52) U.S. Cl.

CPC ..... *B65H 11/005* (2013.01); *B41J 11/007* (2013.01); *B41J 11/0085* (2013.01); *B65H 5/224* (2013.01); *B65H 29/32* (2013.01); *B65H 2406/3223* (2013.01)

(58) Field of Classification Search

CPC ..... B41J 11/007; B41J 11/0085; B41J 11/06; B65H 5/224; B65H 11/005; B65H 2406/3622; B65H 2406/3222; B65H 29/242

See application file for complete search history.

(56) References Cited

U.S. PATENT DOCUMENTS

| | | | |
|---|---|---|---|
| 9,604,813 | B1 | 3/2017 | Herrmann et al. |
| 2009/0244242 | A1 | 10/2009 | Sawada |
| 2010/0171804 | A1 | 7/2010 | Takahashi |
| 2012/0056925 | A1 | 3/2012 | Yamagishi et al. |
| 2020/0361225 | A1* | 11/2020 | Escudero Gonzalez ..... B41J 11/06 |

FOREIGN PATENT DOCUMENTS

| | | | |
|---|---|---|---|
| EP | 1642728 | A2 | 4/2006 |
| ES | 2310490 | A1 | 1/2009 |
| JP | 2007031007 | A | 2/2007 |

(Continued)

OTHER PUBLICATIONS

European Search Report for Corresponding European Application No. EP 19383027 (2 Pages) (dated Mar. 30, 2020).

*Primary Examiner* — Luis A Gonzalez
(74) *Attorney, Agent, or Firm* — LUCAS & MERCANTI, LLP

(57) ABSTRACT

A substrate printing system is disclosed having a perforated conveyor belt adapted for transporting on the same a substrate to be printed, wherein the perforated conveyor belt has a set of perforations; a perforated grill which has a set of perforations and which is configured such that the perforated conveyor belt can be moved over the perforated grill; and a suction chamber which has a suction element, the suction chamber being in communication with the perforated conveyor belt and with the perforated grill such that the suction flow created by the suction element is adapted for passing through perforations of the perforated conveyor belt and of the perforated grill to secure the substrate to the perforated conveyor belt.

9 Claims, 5 Drawing Sheets

(56) References Cited

FOREIGN PATENT DOCUMENTS

| | | | |
|---|---|---|---|
| JP | 2009234017 | A | 10/2009 |
| JP | 2012051331 | A | 3/2012 |
| JP | 2016150796 | A | 8/2016 |
| JP | 2018531167 | A | 10/2018 |
| WO | 2017060875 | A1 | 4/2017 |

* cited by examiner

SUBSTRATE PRINTING SYSTEM

CROSS REFERENCE TO RELATED APPLICATION

This application claims the benefit of priority of European Patent Application No. 19383027.0, filed on Nov. 21, 2019, which is incorporated herein by reference.

TECHNICAL FIELD

The object of the present invention is a substrate printing system, substrates for example laminar substrates, in particular strips, grills, sheets, plates, panels, etc. on a conveyor belt, especially a system adapted for an inkjet printing machine.

STATE OF THE ART

At present, inkjet printing machines have a transport system for transporting substrates to be printed by means of a perforated conveyor belt which moves forward supported and rubbing on one or some flat and static perforated metal grills. Said perforated grills are the upper closure of leak-tight chambers or lines, with some residual losses, on the rest of their surfaces.

In these chambers or lines, by means of suction elements, for example fans with radial impellers, air suction is generated which circulates through the perforations of these grills and in turn through the perforations of the conveyor belt.

The suction chambers or lines may be adjustable in width by means of moving lateral plates with vertical closures. Using these lateral plates, the perforations of the laterals of the perforated grill can be disabled, thus leaving open the perforations which correspond to the measurement in width of the substrate to be printed. That is to say, the perforated grills can be varied in width according to the different machines. Normal measurements are between 1560 mm and 2190 mm. By means of the lateral plates, it is possible to adjust this dimension in width to that of the substrate to be printed, leaving disabled the perforations which are not necessary in the laterals of the substrate to be printed.

In this way, the air flow through the perforations of the perforated conveyor belt is also adjusted in width as necessary.

The substrates on which printing will be carried out, when they are delivered to the conveyor belt, are secured to said conveyor belt because in the perforations of the conveyor belt which are covered by said substrate a vacuum is formed which exerts a suction force which fixes the substrate to the belt and allows it to advance at its rhythm without having relative movements between them.

In FIG. 2, different ways are shown in which the substrates can normally be delivered to the conveyor belt; they are the following:

- Delivery of single substrate (FIG. 2, left). One substrate is delivered after another, leaving a gap between contiguous substrates. It is recommended that this gap is as small as possible.
- Delivery of a double paired substrate (FIG. 2, centre). Two pieces of substrate are delivered in parallel and then another two and so on successively, leaving a gap between one delivery and the next one.
- Delivery of a double unpaired substrate (FIG. 2, right). Two pieces of substrate parallel to one another, but which have a longitudinal divergence are delivered. Laterally, the suction is adjusted, in any of these three cases, by means of the previously mentioned lateral plates.

In addition, the longitudinal central area of the perforated conveyor belt may not have perforations, thus, in the central area there is no suctioned air flow when double substrate printing is carried out.

However, in the direction of travel of the substrates, gaps are established between consecutive substrates which leave perforations of the perforated conveyor belt exposed, as they are not covered by said substrates. The number of perforations without covering is greater when we find ourselves in the case of double unpaired delivery.

A suction air flow circulates through these perforations. This air flow, in the area of the printing heads, and when printing is being carried out, produce undesired and uncontrollable effects. Some defects produced are the following:

- Turbulences are produced which are translated into print defects in the areas of the borders of the substrates, for example lack of ink, smudged prints, blurs, etc.
- Part of the ink injected in the limit areas of the substrates is pulled by the suction air flow and causes soiling by deposition, not only on the perforated conveyor belt, but also on the perforated metal grills, in the suction lines and in general in the circuit through which the suction air circulates.

The objective of the printing system object of the invention is to provide a system which reduces or eliminates the drawbacks caused by the suction air flow, improving the printing in the limit areas of the substrates and reducing the soiling due to suctioned ink.

OBJECT OF THE INVENTION

The present invention relates to printing system of the type that comprises:

- A perforated conveyor belt adapted for transporting on the same a substrate to be printed, wherein the perforated conveyor belt comprises a set of perforations.
- A perforated grill which comprises a set of perforations and which is configured such that the perforated conveyor belt can be moved over the perforated grill.
- A suction chamber which comprises a suction element, the suction chamber being in communication with the perforated conveyor belt and with the perforated grill such that the suction flow created by the suction element is adapted for passing through perforations of the perforated conveyor belt and of the perforated grill to secure the substrate to the perforated conveyor belt.

It is conceived that the printing system according to the invention can have more than one suction chamber, for example each one with a suction element and with one or more perforated grills. Normally, more than one suction chamber is used, for example, three in order to be able to distribute the suction power required between the different chambers.

In a first aspect, the invention is characterised in that the perforations of the perforated grill have a different pattern in one area adapted for printing substrates than in an area not adapted for printing substrates.

In the context of the present invention, pattern of holes should be understood in particular as a distribution, shape and/or dimensions of the holes. Moreover, area adapted for printing substrates should be understood in particular as the area above which the printing heads are provided for printing the substrates when they are situated below the heads.

Providing a different pattern in the area to be printed makes it possible to minimise or reduce the problems mentioned in the printing, in relation to the suction air flow, by means of adjusting or distributing the securing force of the substrates to the belt in the printing area. In particular, the printing system can be adapted to different substrates or types of substrate, for example with different dimensions or weights, preventing or reducing the printing defects in the areas of the borders of the substrates to be printed.

Preferably, the perforations of the perforated grill are configured to produce greater blocking of the suction flow through said perforations in the area adapted for printing substrates than in the area not adapted for printing substrates.

In the context of the present invention, blocking a suction flow through a hole should be understood in particular as directly (at least partially) covering said hole to reduce or cancel out the suction flow through the hole, that is to say, to reduce or cancel out the area passed through by the suction flow in said hole. Thus, greater blocking should be understood in particular as the total area of said perforations passed through by the suction flow being lower, for example reducing the number of perforations or the area of each perforation.

Providing greater blocking enables the suction flow to be reduced (and a lower securing force of the substrate to the perforated conveyor belt). The reduction of the suction flow locally allows the adverse effects in printing caused by the suction flow, as explained above, to be reduced. In particular, the air flow around the substrates to be printed can be reduced to prevent turbulences in the ink and the suction of the ink together with the air flow through the perforations.

According to the invention, it is possible to reduce the total percentage of the suction surface, minimally affecting the fastening force of the substrate to the perforated conveyor belt.

Additionally, the perforated grill is preferably removable in the area adapted for printing substrates with respect to the area not adapted for printing substrates.

In a second aspect of the invention, it is conceived that the perforated grill is removable in an area adapted for printing substrates with respect to an area not adapted for printing substrates. That is to say, independently of fact that the perforations of the perforated grill have a different pattern in one area adapted for printing substrates than in an area not adapted for printing substrates.

In the context of the present invention, removable perforated grill should be understood in particular as it can be removed and replaced in its position, maintaining the integrity of the system, in particular by means of non-permanent fastening means such a screws, interference fit, etc. At the same time, removable perforated grill should be understood as the printing system being configured so that the perforated grill can be changed, for example for cleaning, repair or maintenance of the system.

Unlike the printing systems of the state of the art wherein the perforated grill is connected to the rest of the structure of the suction chamber by means of soldering, according to the invention using the removable perforated grill it is possible to remove the sheet easily for cleaning the perforated grill and for carrying out the required maintenance as a result of soiling of the system produced by the printing ink when printing. At the same time, as it is possible to remove the removable perforated grill and accordingly leave the suction chamber open in the printing area, this allows access to the interior of the suction chamber to facilitate cleaning, repair and maintenance even in the interior.

Preferably, in relation to the second aspect of the invention, it is also envisaged that the perforations of the perforated grill have a different pattern in the area adapted for printing substrates than in the area not adapted for printing substrates.

Advantageously, the perforated grill can be replaced with another perforated grill with a pattern different from the previous one. In this way, a suitable pattern can be selected for printing different types of substrates, for example substrates with different dimensions, thicknesses, materials, etc. or in general different types of substrates whose features can influence the printing. In this sense, it can be observed that, for example, the distance of the printing heads to the surface to be printed of the substrate, the fastening force of the substrate, the distribution on the substrate of the surface to be printed, the type of printing to be carried out on the substrate, etc. can influence the printing.

In relation to the effect of the spacing of the printing heads to the surface to be printed of the substrate and to the conveyor belt, it can be observed that the shorter the distance of the heads to the substrate, the better the printing because the shooting trajectory of ink is more precise. However, the shorter the distance of the heads to the conveyor belt, the greater the influence of the turbulences of the suction air flow. Therefore, in general, when the thickness of the substrate reduces or the distance of the heads to the substrate reduces, the adverse effects of the suction air flow on the ink are greater.

Preferably, the perforations of the perforated grill are configured to produce greater blocking of the suction flow through said perforations in the area adapted for printing substrates than in the area not adapted for printing substrates. In this way, as previously explained, the suction flow can be reduced in the printing area and therefore, the printing improved.

In a third aspect of the invention, the system comprises blocking means to at least partially block the suction flow through perforations to a different extent in an area adapted for printing substrates than in an area not adapted for printing substrates.

According to the invention, it is envisaged that the means have the shape of, for example, valves or inserts for blocking the perforations in the area adapted for printing substrates.

Preferably, according to the invention, it is envisaged that the blocking means have the shape of a laminar blocking element which is arranged parallel to the perforated conveyor belt in the area adapted for printing substrates. The blocking means serve to block the suction flow through the holes or perforations, that is to say, directly (at least partially) cover said hole to reduce or cancel out the suction flow through the hole to reduce or cancel out the area passed through by the suction flow in said hole. In order to achieve greater blocking, the total area of the perforations passed through by the suction flow should be smaller.

It is conceived that the laminar blocking element extends in a plane parallel to the perforated conveyor belt. The blocking element can be formed, for example by a sheet, plate, strip or similar.

The laminar blocking element is preferably provided with a set of perforations for the passage of the suction air flow. The perforations of the laminar blocking element are more preferably configured to produce greater blocking of the suction flow through the perforations of the conveyor belt, the perforated sheet and the laminar blocking element, in the area adapted for printing substrates than in the area not adapted for printing substrates. In particular, the perforations of the laminar blocking element have a pattern different from that of the perforations in the perforated grill.

Alternatively or complementarily, the laminar blocking element is permeable to the suction flow in an area of said element which does not have perforations.

According to the invention, it is also envisaged that the laminar blocking element can be disposable once printing is completed or replaceable every now and then. In this way, it is also possible to solve the technical problem of the invention without the need to introduce or modify constructive elements in the printing machine by way of which the printing system can be simplified.

In one possible embodiment, the laminar blocking element is fixed on the perforated grill in contact therewith. In particular, the laminar blocking element is fixed to the perforated grill in a housing of the perforated grill and flush with the same on the surface external to the suction chamber.

In another possible embodiment, the laminar blocking element is arranged stationary on the perforated conveyor belt, between substrate and perforated conveyor belt.

In another additional embodiment, it is conceived that the blocking means are removable with respect to the perforated conveyor belt and/or the perforated grill. In this way, the cleaning, repair or maintenance thereof is facilitated or the use thereof is simplified in the case of being able to be substituted, replaced or disposed of.

The blocking means are preferably configured to block at least partially the perforations of the perforated conveyor belt and/or the perforated grill which are not adapted for being covered by the substrate. In this way, the blocking is concentrated in the areas not covered by the substrates to be printed, in the gaps around the same.

The printing system according to the invention can be used, as previously described, to print different substrates or types of substrate, for example with different dimensions, thicknesses or weights. For example, it is possible to provide printing systems with different patterns in the printing area for printing one predetermined type of substrate, or to provide removable perforated sheets with different patterns of perforations or blocking means, in particular laminar blocking elements with different patterns of perforations, as a function of the different types of substrates to be printed.

Advantageously, the invention makes it possible for the reduction of the flow around the substrate to preferably be carried out in the printing area, without the suction in the rest of the perforated conveyor belt being impaired.

BRIEF DESCRIPTION OF THE FIGURES

In order to complete the description and with the aim of providing a better understanding of the invention, some figures are provided. Said figures form an integral part of the description and illustrate an exemplary embodiment of the invention.

DETAILED DESCRIPTION OF THE INVENTION

Figure 1:
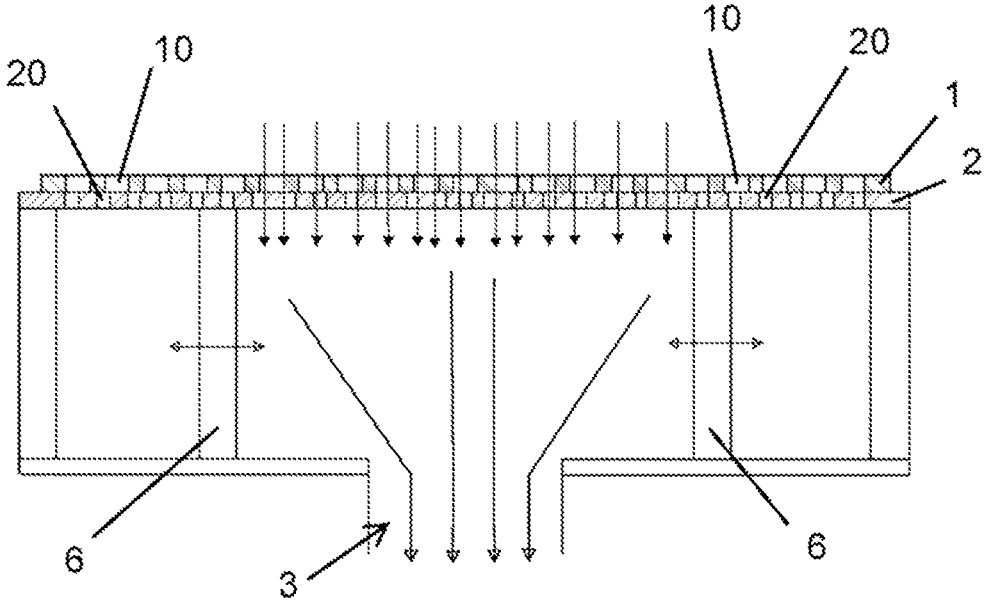
FIG. 1 shows a transversal schematic view of a printing machine of the type to which the invention is applied.
Figure 2:
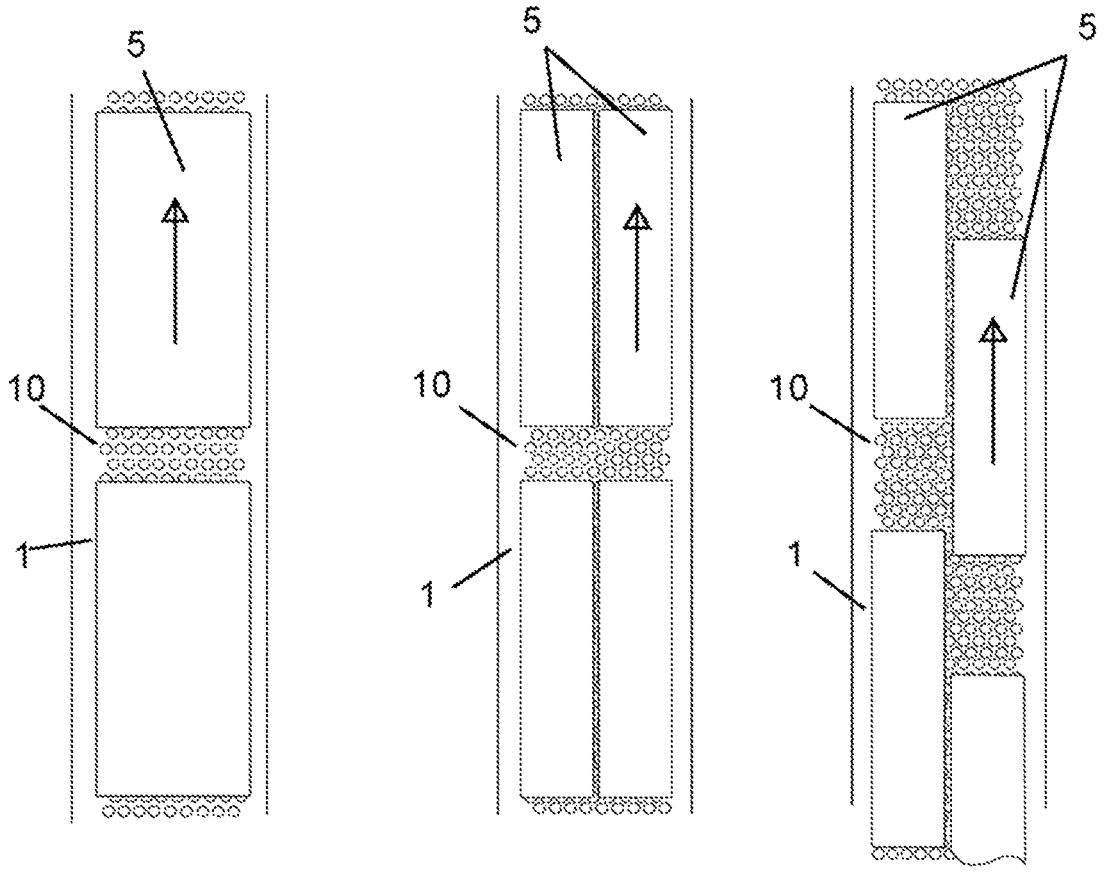
FIG. 2 shows a schematic plan view of three exemplary embodiments for supplying a substrate on a perforated conveyor belt.
Figure 5:
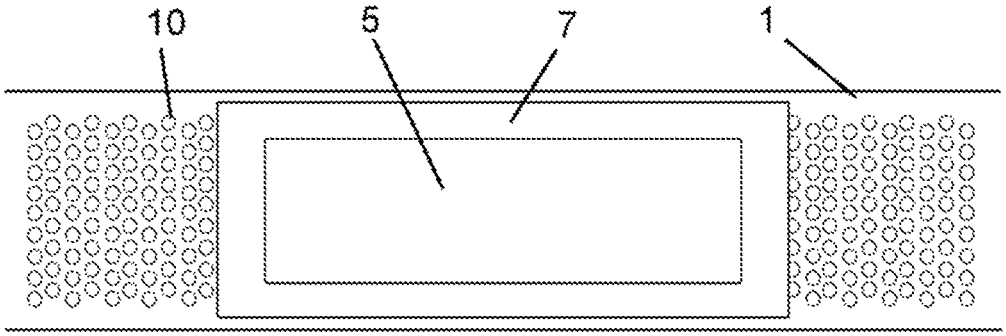
FIG. 5 shows a schematic plan view of the conveyor belt on which a laminar blocking element is arranged between a substrate to be printed and the conveyor belt according to an embodiment of the invention.

An exemplary embodiment of a printing machine according to the invention is represented in FIG. 1, comprising:

- The perforated conveyor belt (1) which is mobile and transports on the same the substrate (5) to be printed. Accordingly, the perforated conveyor belt (1) is represented in FIGS. 2 and 5, comprising a set of perforations (10).
- The perforated grill (2) which is static and which, in the exemplary embodiment, is also metal. The perforated conveyor belt (1) is moved over said perforated grill (2). The perforated grill (2) comprises a set of perforations (20).
- The suction chamber (3), represented in FIG. 1, comprises a suction element (not represented) which creates a suction flow which passes through the perforations (10, 20) of the perforated conveyor belt (1) and of the perforated grill (2) to secure the substrate (5) to the perforated conveyor belt (1).

The solution of the state of the art relating to the vertical lateral plates (6) of the suction chamber is also represented in FIG. 1 which may be adjustable in width by means of moving the same (6). Using these lateral plates (6), the perforations (20) of the laterals of the perforated grill (2) can be disabled, to a greater or lesser extent, thus leaving open the perforations (20) which correspond to the measurement in width of the substrate (5) to be printed.

Figure 3:
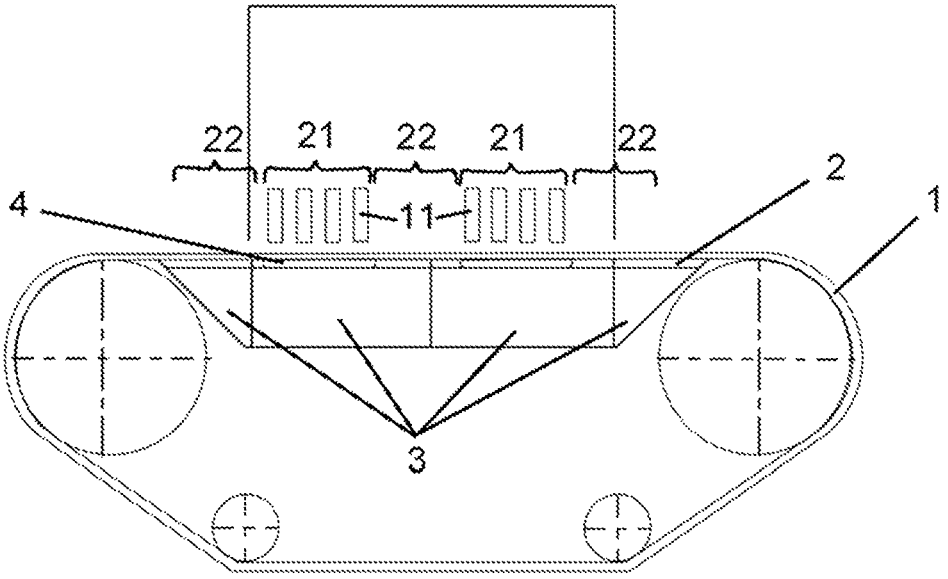
FIG. 3 shows a lateral schematic section to the perforated conveyor belt, of the perforated grill and to the suction chamber of an exemplary embodiment of the invention.

In the exemplary embodiment according to the invention corresponding to FIG. 3, an area (21) is shown adapted for printing and an area (22) not adapted for printing. In the area (21) adapted for printing, the printing heads (11) are arranged over the conveyor belt (1) for printing the substrates (5) while they advance with the movement of the conveyor belt (1) below the printing heads (11). The different areas (21) adapted for printing can be for printing different colours. According to the embodiment shown, both in the printing area (21) and in the area (22) where there is no printing, the securing of the substrates (5) is caused by the suction air flow which passes through the conveyor belt (1) and the perforated grill (2) when being suctioned by the suction elements of the suction chambers (3).

The perforated grill (2) shown in the embodiment of FIG. 3 is removable (4) in each one of the two suction areas (21) according to the embodiment, allowing it, for example, to be removed and substituted with other perforated grills (2) for the cleaning, repair or maintenance thereof and access to the suction chambers (3) once removed.

Figure 4A:
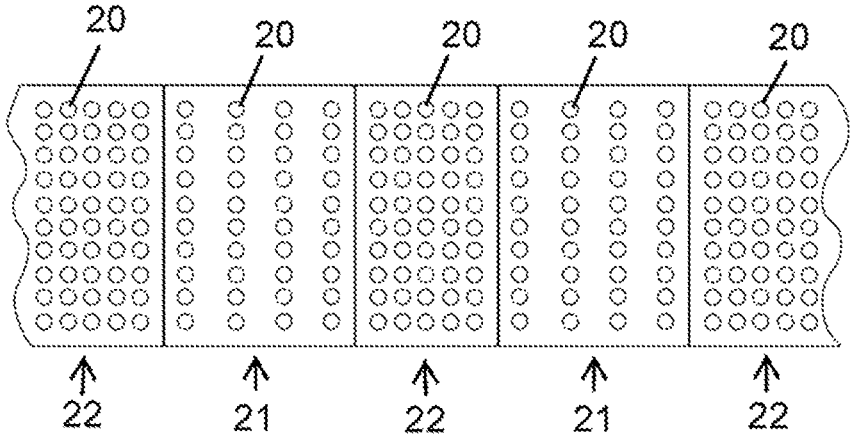
FIGS. 4*a*, 4*b* show a schematic plan view of the perforated grill according to respective embodiments according to the invention.
Figure 4B:
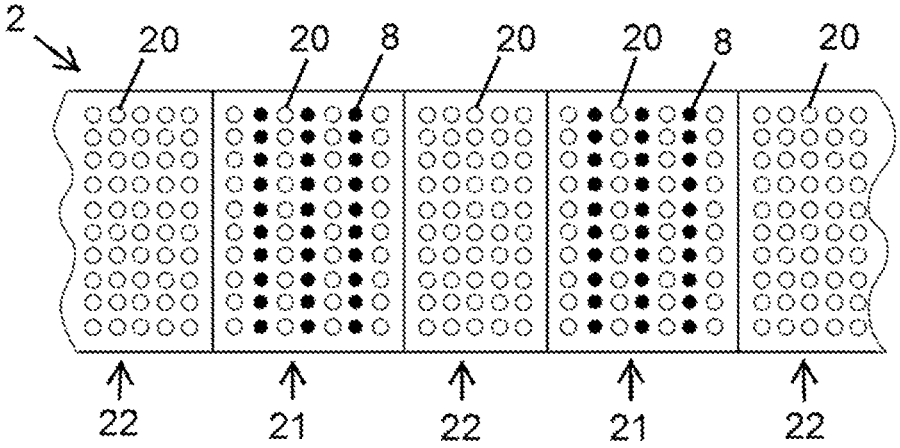

In FIGS. 4*a* and 4*b*, embodiments are shown of the perforated sheet (2) according to the invention wherein the perforations (20) in the printing area (21) have a pattern different from the perforations (20) in the area (22) where there is no printing, in this case to produce greater blocking (fewer number of holes which can be open to the passage of the suction air flow) in the printing area (21) than in the area (22) where there is no printing. The difference between both embodiments of FIGS. 4*a* and 4*b* is that in the embodiment of FIG. 4*b*, the blocking is caused by means of blocking valves or inserts (8) arranged in the perforations shown for completely blocking each one of said perforations (20). The perforated grill (2) is preferably removable in the printing areas (21).

The perforated conveyor belt (1) is moved on the optionally removable perforated grill (2), leaving some of the perforations (10) of the perforated conveyor belt (1) blocked by the perforated grill (2) itself. In this way, the perforations (10) of the perforated conveyor belt (1) which are not adapted for being covered by the substrate (5) are blocked at least partially by the perforated grill (2).

One of the advantages of implementing removable (4) perforated metal grills (2) is that the cleaning thereof is facilitated and at the same time it also facilitates the cleaning of the housing thereof in the printing areas (21). To this end, the perforated grill (2) can be removably fixed, in particular screwed or similar or simply supported or superimposed on the suction chamber (3). When the removable perforated grills (2) are removed, disassembling them from the upper part of their support structure in the manner of a drawer of the suction chamber (3), access to the suction chamber (3) is also enabled for its cleaning.

To achieve a maximum reduction of the perforations (10) of the perforated conveyor belt (1) which are uncovered, the distribution pattern of the perforations (20) of the removable perforated grill (2) can be contemplated as a function of the different substrates (5) to be printed, in particular of the measurements and features of the substrate (5) to be printed and how the substrates (5) are going to be placed on the perforated conveyor belt (1).

In another exemplary embodiment, the blocking means can be formed by a laminar blocking element (7) parallel to the perforated conveyor belt (1) which is located on the perforated grill (2) and therefore below the perforated conveyor belt (1) in the printing area (21).

Specifically, in this embodiment, the laminar blocking element (7) comprises an additional perforated grill with a set of perforations different from the distribution pattern of the perforated grill (2) in an area (22) where there is no printing, the additional perforated grill (4) being located between the perforated grill (2) and the perforated conveyor belt (1). More specifically, the perforated grill (2) comprises a housing with a determined thickness, for inserting the additional perforated grill. The additional perforated grill (4) will preferably be metal and easy to remove.

The additional perforated grill comprises a perforation distribution pattern which differs from the distribution pattern of the perforations (20) of the perforated grill (2), such that perforations (10) of the perforated conveyor belt (1) which are not adapted for being covered by the substrate (5) are blocked at least partially by the additional perforated grill, preventing or at least minimising the previously indicated problems.

The perforations of the additional perforated grills can be implemented as a function of:

- The measurements and features of the substrate (5) to be printed.
- How the substrates (5) are going to be placed on the perforated conveyor belt (1).

It has also been anticipated that different sets of additional perforated grills can be provided. In this way, either are selected as a function of the features of the laminar substrate (5) and how they are going to be placed on the perforated conveyor belt (1).

As mentioned for the previous exemplary embodiment, the removable condition of these additional perforated grills facilitates their cleaning, removing them from their housings in the perforated grill (2) and thus being taken to a cleaning point.

Another exemplary embodiment is represented in FIG. 5 in which the blocking means are formed by a laminar blocking element (7) parallel to the perforated conveyor belt (1) which travels on the conveyor belt (1) and below the substrate (5). When the laminar blocking element (7) arrives to the printing area (21) with the substrate (5) arranged on the laminar blocking element (7), the blocking of the perforations (10) of the conveyor belt (1) is caused in the printing area (21) with respect to the area (22) where there is no printing.

Figure 6:
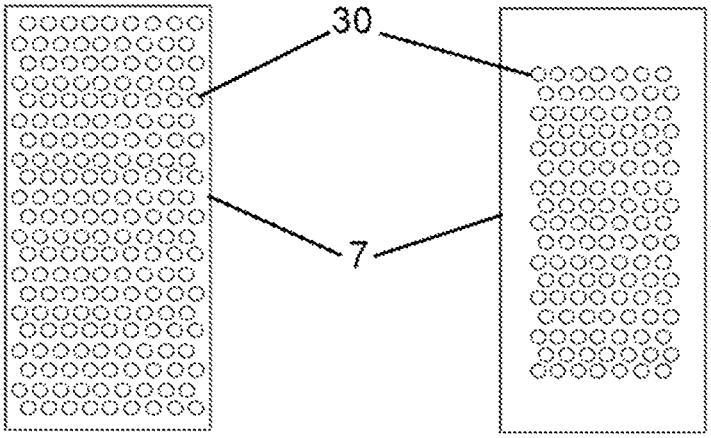
FIG. 6 shows different embodiments of laminar blocking elements according to the invention.

Two embodiments of laminar blocking elements (7) are shown in FIG. 6 configured for being arranged on the conveyor belt (1). In the embodiment on the left, the laminar blocking element presents a set of perforations (30) with a determined pattern on its entire surface. In the embodiment on the right, the laminar blocking element presents a border area without perforations such that in said area the perforations (10) of the conveyor belt (1) are completely blocked, preventing the printing problems of the suction air flow in said border area.

An exemplary embodiment is also envisaged consisting of a permeable strip, for example porous, to the suction flow in an area of the laminar blocking element (7) without perforations (30). In this way, the laminar element allows the passage of suction flow in said permeable area, but reducing the turbulences created by said flow.

It is envisaged that the laminar blocking element (7) can be disposable such that it could be introduced with the substrate (5) on the perforated conveyor belt (1) and removed with the printed substrate (5) at the end of the process. One problem is that as the strip (7) would travel below the substrate (5) for the entire route of the perforated conveyor belt (1), the vacuum would reduce on its entire journey, not only in the printing area. However, it has the advantage of being able to adapt the suction to the type of substrate (5), a type of strip or pattern being selected for each substrate (5).

The following possible exemplary embodiments are envisaged:

- Replacing the entire welded upper grill of the suction cavity in the printing area with an upper sheet grill with removable fixing, such as for example screwing.
- Recess or housing in the welded upper grill to insert in the same an additional perforated grill in the recess.
- Superimposing the additional perforated grill on the conventional welded upper grill.
- Strip which travels on the conveyor belt (1) between the substrates and the conveyor belt (1).

The invention claimed is:

1. A substrate printing system, comprising:

a perforated conveyor belt adapted for transporting a substrate to be printed, wherein the perforated conveyor belt comprises a set of perforations, a perforated grill which comprises a set of perforations and which is configured such that the perforated conveyor belt can be moved over the perforated grill, and a suction chamber in communication with the perforated conveyor belt and with the perforated grill such that a suction flow created by the suction chamber is adapted for passing through perforations of the perforated conveyor belt and of the perforated grill to secure the substrate to the perforated conveyor belt, wherein:

the perforations of the perforated grill have a different pattern in a first area adapted for printing substrates than in a second area not adapted for printing substrates;

the perforations of the perforated grill are configured to produce greater blocking of the suction flow through said perforations in the first area adapted for printing substrates than in the second area not adapted for printing substrates; and the perforated grill is removable in the first area adapted for printing substrates with respect to the second area not adapted for printing substrates;

wherein the substrate printing system further comprises:

a blocking means adapted to at least partially block the suction flow through perforations to a different extent in the first area adapted for printing substrates than in the second area not adapted for printing substrates.

2. The substrate printing system according to claim 1, wherein the blocking means comprise blocking valves or inserts of the perforations in the area adapted for printing substrates.

3. The substrate printing system according to claim 1, wherein the blocking means comprise a laminar blocking element which is arranged parallel to the perforated conveyor belt in the area adapted for printing substrates.

4. The substrate printing system according to claim 3, wherein the laminar blocking element is provided with a set of perforations.

5. The substrate printing system according to claim 4, wherein the set of perforations of the laminar blocking element are configured to produce greater blocking of the suction flow through the set of perforations in the area adapted for printing substrates than in the area not adapted for printing substrates.

6. The substrate printing system according to claim 3, wherein a permeable strip is disposed in at least one area of the laminar blocking element without perforations, wherein the laminar blocking element is permeable to the suction flow in the at least one area.

7. The substrate printing system according to claim 3, wherein the laminar blocking element is fixed on the perforated grill in contact with the same.

8. The substrate printing system according to claim 3, wherein the laminar blocking element is arranged stationary on the perforated conveyor belt between substrate and perforated conveyor belt.

9. The substrate printing system according to claim 1, wherein the blocking means are removable with respect to the perforated conveyor belt and/or the perforated grill.

* * * * *